US005936359A

United States Patent [19]

Gibson

[11] Patent Number: 5,936,359

[45] Date of Patent: Aug. 10, 1999

[54] APPARATUS FOR EFFICIENT REMOTE BALLASTING OF GASEOUS DISCHARGE LAMPS

[75] Inventor: J. Alan Gibson, Richmond Hill, Canada

[73] Assignee: Trojan Technologies, Inc., Canada

[21] Appl. No.: 08/118,878

[22] Filed: Sep. 9, 1993

[30] Foreign Application Priority Data

Sep. 11, 1992 [CA] Canada ..... 2078051

[51] Int. Cl.[6] ..... H05B 41/24

[52] U.S. Cl. ..... 315/276; 315/121; 315/144; 315/244; 315/DIG. 5; 439/623; 439/610

[58] Field of Search ..... 315/219, 224, 315/244, 278, DIG. 5, DIG. 7, 121, 144, 276; 439/610, 623

[56] References Cited

U.S. PATENT DOCUMENTS

| | | | |
|---|---|---|---|
| 3,848,164 | 11/1974 | Otte | 439/610 |
| 3,971,967 | 7/1976 | Hawkins | 315/97 |
| 4,090,767 | 5/1978 | Tregoning | 439/610 |
| 4,158,156 | 6/1979 | Knoll | 315/DIG. 5 |
| 4,207,497 | 6/1980 | Capewell et al. | 315/96 |
| 4,210,846 | 7/1980 | Capewell et al. . | |
| 4,229,780 | 10/1980 | Nelson | 362/218 |
| 4,382,653 | 5/1983 | Blanchard | 439/610 |
| 4,388,563 | 6/1983 | Hyltin | 315/205 |
| 4,500,796 | 2/1985 | Quin | 307/147 |
| 4,523,128 | 6/1985 | Stamm et al. | 315/291 |
| 4,626,747 | 12/1986 | Nilssen | 315/209 R |
| 4,717,863 | 1/1988 | Zeiler | 315/307 |
| 4,855,883 | 8/1989 | Spitz | 362/260 |
| 5,028,846 | 7/1991 | Lesea . | |
| 5,053,681 | 10/1991 | Bundy et al. | 315/DIG. 5 |
| 5,081,401 | 1/1992 | Moisin | 315/DIG. 5 |

FOREIGN PATENT DOCUMENTS 1054794 1/1967 United Kingdom .

*Primary Examiner*—Arnold Kinkead
*Attorney, Agent, or Firm*—Ratner & Prestia

[57] ABSTRACT

Remote ballasting apparatus adapted for insertion between a high frequency power source and one or more gaseous discharge lamps. The ballasting apparatus includes an isolation transformer having a primary winding adapted for connection to the high frequency power source, a low capacitance power transmission line having an output end adapted for connection to the one or more gaseous discharge lamps, and current limiting means, such as an inductor or a capacitor or a series resonant circuit connected between the secondaries of the isolation transformer and the input end of the low capacitance power transmission line.

25 Claims, 2 Drawing Sheets

APPARATUS FOR EFFICIENT REMOTE BALLASTING OF GASEOUS DISCHARGE LAMPS

FIELD OF THE INVENTION

This invention relates to the remote ballasting of gaseous discharge lamps such as fluorescent tubes.

BACKGROUND OF THE INVENTION

The operation of gaseous discharge lamps at high frequency is well known and the benefits of this operation have been listed in part in the literature.

U.S. Pat. No. 3,971,967

ISSUED: Jul. 27, 1976

INVENTOR: Henry H. Hawkins

ASSIGNEE: H. H. Hawkins Ltd.

U.S. Pat. No. 4,207,497

ISSUED: Jun. 10, 1980

INVENTOR: Dennis Capewell, et al.

ASSIGNEE: Lutron Electronics, Ltd.

U.S. Pat. No. 4,388,563

ISSUED: Jun. 14, 1983

INVENTOR: Tom M. Hyltin

ASSIGNEE: Commodore Electronics. Ltd.

U.S. Pat. No. 4,500,796

ISSUED: Feb. 19, 1985

INVENTOR: Murray L. Quin

ASSIGNEE: Emerson Electric Co.

U.S. Pat. No. 4,523,128

ISSUED: Jun. 11, 1985

INVENTOR: Thomas A. Stamm et al.

ASSIGNEE: Honeywell Inc.

U.S. Pat. No. 4,626,747

ISSUED: December 1986

INVENTOR: Ole K. Nilssen

ASSIGNEE: *

U.S. Pat. No. 4,717,863

ISSUED: Jan. 5, 1988

INVENTOR: Kenneth T. Zeller

ASSIGNEE: *

U.S. Pat. No. 4,855,883

ISSUED: Aug. 8, 1989

INVENTOR: Russell W. Spitz

ASSIGNEE: *

U.S. Pat. RE: 31,970

ISSUED: Aug. 13, 1985

INVENTOR: David H. Riesland et al.

ASSIGNEE: *

However, the ballast equipments currently available supplied for the high frequency operation of the lamps have either explicit in their instructions or implicit in their use that the ballast be located within approximately 10 feet of the lamp. In many applications, such as drying of printing ink, outdoor lighting, explosion proof environments, water treatment and portable lamps, it is not convenient to locate the ballast near to the lamp. In addition, using present means of connecting, even at shorter distances, large amounts of electrical noise interference are generated that cause erratic operation of other nearby electronic equipment. Finally, existing ballasts do not allow monitoring with ground fault interrupter equipments to reduce the hazard of electric shock to persons as the capacitive leakage currents generated by the high frequencies trip ground fault interrupters.

It is therefore an object of the invention to provide a safe, efficient, non-interfering device which obviates many of the problems of exiting prior art structures.

Further and other objects of this invention will become apparent to a man skilled in the art when considering the following summary of the invention and the more detailed description of the preferred embodiments illustrated herein.

SUMMARY OF THE INVENTION

According to one aspect of the invention, a device is provided for connection between a source of high frequency electric power and a pair of gaseous discharge lamps comprising:

(I) a high frequency isolation transformer having a primary winding and first and second secondary windings arranged in a center tapped secondary configuration and wound to minimize interwinding capacitance connected to;

(II) a resonant circuit to limit lamp current made up of a pair of inductors and capacitors having the first secondary of the transformer connected to one side of a first inductor, the other side of the first inductor connected to a node comprising a first capacitor and the input end of the first conductor of a low capacitance power transmission cable, the other side of the first capacitor is connected to a node comprising one side of the second capacitor, the center tap of the transformer, a third conductor and a sheath conductor of a transmission cable and the other side of the second capacitor connected to a node comprising the input end of the second conductor of the transmission cable and one side of a second inductor with the other side of the second inductor that is connected to the transformer second secondary;

(III) a low capacitance power transmission cable having an input end and an output end comprising at least first, second and third conductors with insulation means and an outer sheathing conductor surrounding the first, second and third conductors and insulated from the conductors;

(IV) the output end of the power transmission cable being connected with the first conductor connected to one end of a first gaseous discharge lamp, the second conductor connected to one end of a second gaseous discharge lamp, the other ends of the gaseous discharge lamps are connected to the output end of the third conductor.

According to another aspect of the invention, there is provided a ballast apparatus for starting and operating a gaseous discharge lamp which allows operation of the lamps at frequencies in excess of 10 kilohertz and at a predetermined distance wherein the predetermined distance is dependent on the use of the apparatus and in a preferred embodiment, when operating the lamp remotely of the ballast apparatus, the predetermined distance being distances greater than ten feet from the power supply, the apparatus comprising a high frequency power supply, and suitable current limiting means, for example a capacitor, an inductor, a series connected resonant circuit or the like, connected to the primary winding of an isolation transformer comprising at least a primary winding and first and second secondary windings arranged in a center tapped secondary configuration and wound to minimize interwinding capacitance, a low capacitance power transmission cable having an input end and an output end comprising a first and second conductor with insulation means and an outer sheathing conductor surrounding the first and second conductor and insulated from both the conductors connected with the input end of the first and second conductors connected to the first and second secondary windings respectively of the isolation transformer and the sheathing conductor connected to the center tap of the isolation transformer, the output end of the power transmission cable is connected with the first conductor connected to one end of a gaseous discharge lamp and the second conductor connected to the other end of the gaseous discharge lamp.

According to another aspect of the invention, there is provided a ballast apparatus for starting and operating a gaseous discharge lamp which allows operation of the lamps at frequencies in excess of 10 kilohertz and at a predetermined distance (wherein the predetermined distance is dependent on the use of the apparatus and in a preferred embodiment, when operating the lamp remotely of the ballast apparatus, the predetermined distance being greater than ten feet) from the power supply comprising a high frequency power supply connected to the primary winding of an isolation transformer comprising at least a primary winding and first and second secondary windings arranged in a center tapped secondary configuration and wound to minimize interwinding capacitance, a low capacitance power transmission cable having an input end and output end comprising first and second conductors with insulation means and an outer sheathing conductor surrounding the first and second conductors and insulated from both the conductors connected with the input end of the first and second conductors connected in series through first and second current limiting means respectively to the first and second secondary windings respectively of the isolation transformer and the sheathing conductor connected to the center tap of the isolation transformer, the output end of the power transmission cable is connected with the first conductor connected to one end of a gaseous discharge lamp and the second conductor connected to the other end of the gaseous discharge lamp.

According to another aspect of the invention, there is provided a ballast apparatus for starting and operating a pair of gaseous discharge lamps which allows operation of the lamps at frequencies in excess of 10 kilohertz and at a predetermined distance (wherein the predetermined distance is dependent on the use of the apparatus and in a preferred embodiment when operating the lamp remotely of the ballast apparatus the predetermined distance being greater than ten feet) from the power supply comprising a high frequency power supply connected to the primary winding of an isolation transformer comprising at least a primary winding and first and second secondary windings arranged in a center tapped secondary configuration and wound to minimize interwinding capacitance, a low capacitance power transmission cable having an input end and an output end comprising at least first, second and third conductors with insulation means and an outer sheathing conductor surrounding the first, second and third conductors and insulated from the conductors connected with the input end of the first and second conductors connected in series through first and second current limiting means respectively to the first and second secondary windings respectively of the isolation transformer and the sheathing and third conductors connected to the center tap of the isolation transformer, the output end of the power transmission cable is connected with the first conductor connected to one end of a first gaseous discharge lamp, the second conductor connected to one end of a second gaseous discharge lamp the other ends of the gaseous discharge lamps are connected to the output end of the third conductor.

According to another aspect of the invention, there is provided a ballast apparatus for starting and operating a gaseous discharge lamp which allows operation of the lamps at frequencies in excess of 10 kilohertz and at a predetermined distance (wherein the predetermined distance is dependent on the use of the apparatus and in a preferred embodiment when operating the lamp remotely of said ballast apparatus the predetermined distance being greater than ten feet) from the power supply comprising a high frequency power supply and a series resonant circuit connected with the first side of an inductor connected to one terminal of the high frequency power supply and the second side of the inductor to a node which is the first side of a capacitor and the first side of the primary winding of an isolation transformer, the second side of capacitor is connected to a node which is the second side of the primary of the isolation transformer and the other terminal of the power supply, the isolation transformer comprising at least a primary winding and first and second secondary windings arranged in a center tapped secondary configuration and wound to minimize interwinding capacitance, a low capacitance power transmission cable having an input end and an output end comprising a first and second conductor with insulation means and an outer sheathing conductor surrounding the first and second conductor and insulated from both the conductors connected with the input end of the first and second conductors connected to the first and second secondary windings respectively of the isolation transformer and the sheathing conductor connected to the center tap of the isolation transformer, the output end of the power transmission cable is connected with the first conductor connected to one end of a gaseous discharge lamp and the second conductor connected to the other end of the gaseous discharge lamp.

According to another aspect of the invention, there is provided a ballast apparatus for starting and operating a gaseous discharge lamp which allows operation of the lamp at frequencies in excess of 10 kilohertz and at a predetermined distance (wherein the predetermined distance is dependent on the use of the apparatus and in a preferred embodiment when operating the lamp remotely of the ballast apparatus the predetermined distance being greater than ten feet) from the power supply comprising a high frequency power supply connected to the primary winding of an isolation transformer comprising at least a primary winding and first and second secondary windings arranged in a center tapped secondary configuration and wound to minimize interwinding capacitance, a low capacitance power transmission cable having an input end and an output end comprising a first and second conductor with insulation means and an outer sheathing conductor surrounding the first and second conductor and insulated from both the conductors connected with the input end of the first and second conductors connected in series through first and second current limiting inductors respectively to the first and second secondary windings respectively of the isolation transformer and the sheathing conductor connected to the center tap of the isolation transformer, the output end of the power transmission cable is connected with the first conductor connected to one end of a gaseous discharge lamp and the second conductor connected to the other end of the gaseous discharge lamp.

According to another aspect of the invention, there is provided a ballast apparatus for starting and operating a pair of gaseous discharge lamps which allows operation of the lamps at frequencies in excess of 10 kilohertz and at a predetermined distance (wherein the predetermined distance is dependent on the use of the apparatus and in a preferred embodiment when operating the lamp remotely of the ballast apparatus the predetermined distance being greater than ten feet) from the power supply comprising a high frequency power supply connected to the primary winding of an isolation transformer comprising at least a primary winding and first and second secondary windings arranged in a center tapped secondary configuration and wound to minimize interwinding capacitance, a low capacitance power transmission cable having an input end and an output end comprising at least first, second and third conductors with insulation means and an outer sheathing conductor surrounding the first, second and third conductors and insulated from the conductors connected with the input end of the first and second conductors connected in series though first and second current limiting inductors respectively to the first and second secondary windings respectively of the isolation transformer and the sheathing and third conductors connected to the center tap of the isolation transformer, the output end of the power transmission cable is connected with the first conductor connected to one end of a first gaseous discharge lamp, the second conductor connected to one end of a second gaseous discharge lamp the other ends of the gaseous discharge lamps are connected to the output end of the third conductor.

According to another aspect of the invention, there is provided a ballast apparatus for starting and operating a gaseous discharge lamp which allows operation of the lamp at frequencies in excess of 10 kilohertz and at a predetermined distance (wherein the predetermined distance is dependent on the use of the apparatus and in a preferred embodiment when operating the lamp remotely of the ballast apparatus the predetermined distance being greater than ten feet) from the power supply comprising a high frequency power supply connected to the primary winding of an isolation transformer comprising at least a primary winding and first and second secondary windings arranged in a center tapped secondary configuration and wound to minimize interwinding capacitance, a resonant circuit to limit lamp current made up of one side of a first inductor connected to the transformer first secondary the other side of the first inductor connected to a node consisting of a first capacitor and the input end of the first conductor of a low capacitance power transmission cable having an input end and an output end comprising first and second conductors with insulation means and an outer sheathing conductor surrounding first and second conductors and insulated from both the conductors, the other side of the first capacitor is connected to a node consisting of a side of a second capacitor, the center tap of the transformer, and the sheath conductor of the transmission cable, the other side of the second capacitor is connected to a node consisting of the input end of the second conductor of said transmission cable and one side of a second inductor the other side of the second inductor is connected to the transformer second secondary, the output end of the power transmission cable is connected with the first conductor connected to one end of a gaseous discharge lamp and the second conductor connected to the other end of the gaseous discharge lamp.

According to another aspect of the invention, there is provided a ballast apparatus for starting and operating a pair of gaseous discharge lamps which allows operation of the lamps at frequencies in excess of 10 kilohertz and at a predetermined distance (wherein the predetermined distance is dependent on the use of the apparatus and in a preferred embodiment when operating the lamps remotely of the ballast apparatus the predetermined distance being greater than ten feet) from the power supply comprising a high frequency power supply connected to the primary winding of an isolation transformer comprising at least a primary winding and first and second secondary windings arranged in a center tapped secondary configuration and wound to minimize interwinding capacitance, a resonant circuit to limit lamp current made up of one side of a first inductor connected to the transformer first secondary the other side of the first inductor connected to a node consisting of a first capacitor and the input end of the first conductor of a low capacitance power transmission cable having an input end and an output end comprising at least first, second and third conductors with insulation means and an outer sheathing conductor surrounding the first, second and third conductors and insulated from the conductors, the other side of the first capacitor is connected to a node consisting of a side of a second capacitor, the center tap of the transformer, the third conductor and sheath conductor of the transmission cable, the other side of the second capacitor is connected to a node consisting of the input end of the second conductor of the transmission cable and one side of a second inductor, the other side of the second inductor is connected to the transformer second secondary, the output end of the power transmission cable is connected with the first conductor connected to one end of a first gaseous discharge lamp, the second conductor connected to one end of a second gaseous discharge lamp, the other ends of said gaseous discharge lamps are connected to the output end of the third conductor.

According to another aspect of the invention, the ballast apparatus described in any of the preceding paragraphs may further comprise a number of transformer secondaries with center taps connected to a common node which are connected to a number of lamps via a single transmission cable comprising a number of conductor pairs surrounded by a single outer sheathing conductor which is connected to the center tap common node.

According to another aspect of the invention, the ballast apparatus described in any of the preceding paragraphs may further comprise a number of transformer secondaries with center taps, (preferably which may or may not be connected to a common node), which are connected to a number of lamps via a single transmission cable comprising a number of conductor pairs each pair surrounded by a sheathing conductor which is connected to the respective transformer center tap.

According to another aspect of the invention, the ballast apparatus described in any of the preceding paragraphs may further comprise a number of transformer secondaries with center taps connected to a common node which are connected to a number of lamps via a single transmission cable consisting of a number of three conductor groups surrounded by a single outer sheathing conductor which is connected to the center tap common node.

According to another aspect of the invention, the ballast apparatus described in any of the preceding paragraphs may further comprise a number of transformer secondaries with center taps, (preferably which may or may not be connected to a common node, which are connected to a number of lamps via a single transmission cable comprising a number of conductor groups wherein each group is surrounded by a sheathing conductor which is connected to the respective transformer center tap.

According to another aspect of the invention, the ballast apparatus described in any of the preceding paragraphs may further comprise a single transformer secondary with center tap which is connected to a plurality of lamps via a single transmission cable comprising a number of conductors surrounded by a sheathing conductor which is connected to the transformer center tap.

According to another aspect of the invention, the ballast apparatus described in any of the preceding paragraphs may further comprise a single transformer secondary with center tap which is connected to a plurality of lamps via a single transmission cable comprising a number of conductor groups wherein each group is surrounded by a sheathing conductor which is connected to the transformer center tap.

DETAILED DESCRIPTION OF A PREFERRED EMBODIMENT OF THE INVENTION

Figure 1:
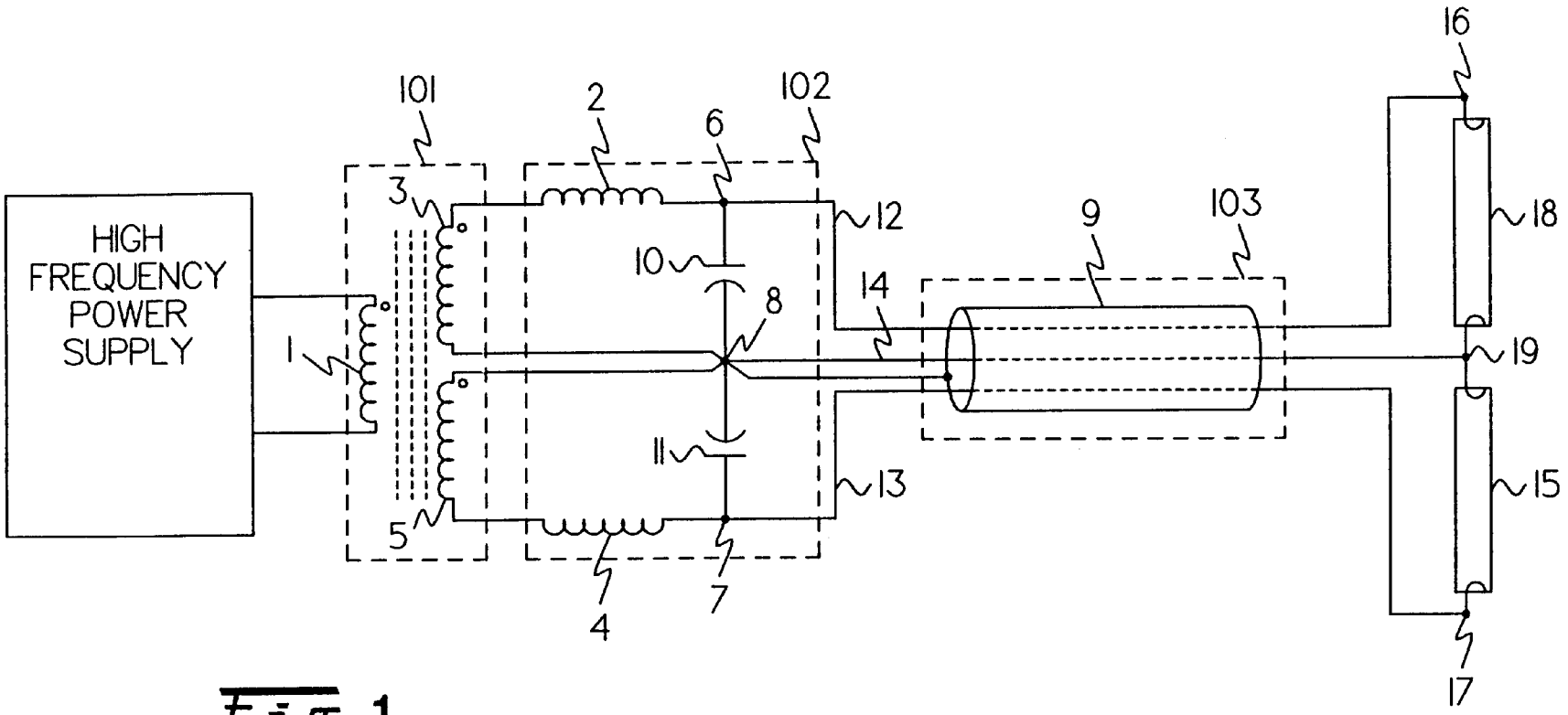
FIG. 1 is a schematic view of a first preferred embodiment of the invention.

With reference to FIG. 1 there is shown a device schematically of one embodiment of the invention. The device consists of three principal parts: the first, an isolation transformer as shown in the box 101; the second a current limiting means, for example an inductor or a capacitor or a series resonant circuit shown in box 102; and the third, a low capacitance power transmission line shown in box 103. High frequency power, typically 31.2 Khz, at 125 volts RMS, is connected to each of the ends of primary winding 1, typically 63 turns #22 AWG, of transformer 101, built on an RM14 core. The marked end (indicated by the small circle) of secondary winding 3, typically 56 turns #24 AWG, is connected to inductor 2 which, in turn, connects to node 6 and capacitor 10. Similarly, the unmarked end of secondary 5 is connected to inductor 4 which, in turn, connects to node 7 and capacitor 11. The other side of capacitors 10 and 11 are connected, along with the unmarked end of secondary 3, the marked end (indicated by the small circle) of secondary 5, conductor 14 and sheath conductor 9, to node 8. The input end of transmission cable 103, for example 40 feet of cable manufactured by Belden (as described in their product catalogue at catalogue number 9365), is connected with a first conductor 12 to node 6, a second conductor 13 to node 7, a third conductor 14 to node 8, and an another sheath conductor 9 to node 8.

The output end of transmission line 103 is connected with conductors 12 and 14 to lamp 18, (F96T12 fluorescent lamp), and conductors 13 and 14 to lamp 15 (F96T12 fluorescent lamp).

Inductors 2 and 4, typically 2 millihenry, and capacitors 10 and 11, typically 12000 picofarads, along with the distributed capacitance of transmission line conductors 12 between nodes 6–16 and 14 between nodes 8–11 and conductors 13 between nodes 7–17 and 14 between nodes 8–11, typically 1000 picofarads, form series resonant circuits which resonate at approximately 31.2 Khz. This resonance will produce an adequate voltage (600 to 800 volts) to initiate conduction in lamps 18 and 15 and then act as near resonant current limiters to maintain a voltage of approximately 200 volts to keep the lamps running.

This configuration as shown in FIG. 1 is a low noise generating balanced load with very small electrical noise radiation inasmuch as any electrical noise generated by minor component imbalances are returned via the shield conductor to the common node 8. For greater noise reduction node 8 can also be grounded.

Figure 2:
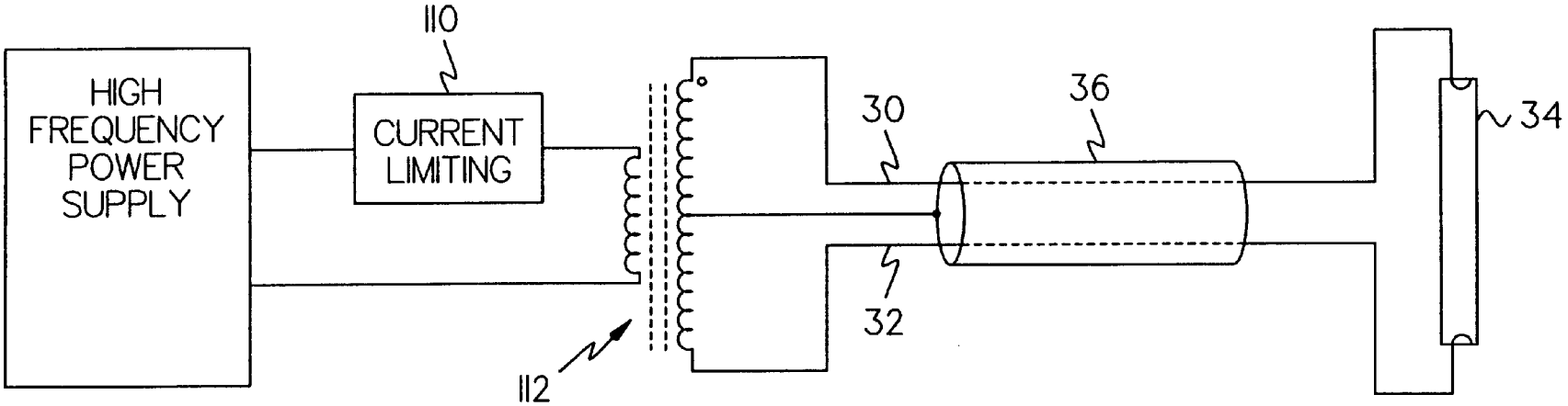
FIG. 2 is a schematic view of a second preferred embodiment of the invention.

FIG. 2, which shows a second preferred embodiment of the present invention, differs from FIG. 1 by the connection of current limiting means 110 to the primary winding of an isolation transformer 112 instead of to the secondary winding of the isolation transformer and by the inclusion of only two conductors 30 and 32 leading to a single lamp 34 instead of three conductors leading to two lamps. An outer sheathing conductor 36, surrounding conductors 30 and 32 and insulated from these conductors, is connected to the center tap of the secondary winding of isolation transformer 112.

As many changes can be made to the preferred embodiments of the invention without departing from the scope or intent thereof, it is intended that all matter contained herein be considered as illustrative of the invention and not in a limiting sense.

What is claimed:

1. A remote ballasting apparatus for starting and operating a gaseous discharge lamp which allows operation of the lamp at frequencies in excess of 10 kilohertz and at a predetermined distance from the power supply comprising: a high frequency power supply and suitable current limiting means connected to the primary winding of an isolation transformer comprising at least a primary winding and first and second secondary windings arranged in a center tapped secondary configuration and wound to minimize interwinding capacitance, a low capacitance power transmission cable having an input end and an output end comprising a first and second conductor with insulation means and an outer sheathing conductor surrounding said first and second conductor and insulated from both said conductors connected with the input end of said first and second conductors connected to the first and second secondary windings respectively of said isolation transformer and the outer sheathing conductor connected to the center tap of said isolation transformer, the output end of said power transmission cable is connected with the first conductor connected to one end of a gaseous discharge lamp and the second conductor connected to the other end of said gaseous discharge lamp.

2. A remote ballasting apparatus for starting and operating a pair of gaseous discharge lamps which allows operation of the lamps at frequencies in excess of 10 kilohertz and at a predetermined distance from the power supply comprising: a high frequency power supply connected to the primary winding of an isolation transformer comprising at least a primary winding and first and second secondary windings arranged in a center tapped secondary configuration and wound to minimize interwinding capacitance, a low capacitance power transmission cable having an input end and an output end comprising at least first, second and third conductors with insulation means and an outer sheathing conductor surrounding said first, second and third conductors and insulated from said conductors connected with the input end of said first and second conductors connected in series through first and second current limiting means respectively to the first and second secondary windings respectively of said isolation transformer and the outer sheathing conductor and third conductors connected to the center tap of said isolation transformer, the output end of said power transmission cable is connected with the first conductor connected to one end of a first gaseous discharge lamp, the second conductor connected to one end of a second gaseous discharge lamp, the other ends of said gaseous discharge lamps are connected to the output end of said third conductor.

3. A remote ballasting apparatus for starting and operating a gaseous discharge lamp which allows operation of the lamp at frequencies in excess of 10 kilohertz and at a predetermined distance from the power supply comprising: a high frequency power supply and a series resonant circuit connected with the first side of an inductor connected to one terminal of said high frequency power supply and the second side of said inductor to a node which is the first side of a capacitor and the first side of the primary winding of an isolation transformer, the second side of said capacitor is connected to a node which is the second side of the primary of said isolation transformer and the other terminal of the power supply, said isolation transformer comprising at least a primary winding and first and second secondary windings arranged in a center tapped secondary configuration and wound to minimize interwinding capacitance, a low capacitance power transmission cable having an input end and an output end comprising a first and second conductor with insulation means and an outer sheathing conductor surrounding said first and second conductor and insulated from both said conductors connected with the input end of said first and second conductors connected to the first and second secondary windings respectively of said isolation transformer and the outer sheathing conductor connected to the center tap of said isolation transformer, the output end of said power transmission cable is connected with the first conductor connected to one end of a gaseous discharge lamp and the second conductor connected to the other end of said gaseous discharge lamp.

4. A remote ballasting apparatus for starting and operating a gaseous discharge lamp which allows operation of the lamp at frequencies in excess of 10 kilohertz and at a predetermined distance from the power supply comprising: a high frequency power supply, first and second current limiting means connected to the secondary winding of an isolation transformer and suitable current limiting means connected to the primary winding of said isolation transformer comprising at least a primary winding and first and second secondary windings arranged in a center tapped secondary configuration and wound to minimize interwinding capacitance, a low capacitance power transmission cable having an input end and an output end comprising a first and second conductor with insulation means and an outer sheathing conductor surrounding said first and second conductor and insulated from both said conductors connected with the input end of said first and second conductors connected in series through said first and second current limiting means respectively to the first and second secondary windings respectively of said isolation transformer and the outer sheathing conductor connected to the center tap of said isolation transformer, the output end of said power transmission cable is connected with the first conductor connected to one end of a gaseous discharge lamp and the second conductor connected to the other end of said gaseous discharge lamp.

5. A remote ballasting apparatus for starting and operating a gaseous discharge lamp which allows operation of the lamp at frequencies in excess of 10 kilohertz and at a predetermined distance from the power supply comprising: a high frequency power supply connected to the primary winding of an isolation transformer comprising at least a primary winding and first and second secondary windings arranged in a center tapped secondary configuration and wound to minimize interwinding capacitance, a resonant circuit to limit lamp current made up of one side of a first inductor connected to the transformer first secondary the other side of the first inductor connected to a node consisting of a first capacitor and the input end of the first conductor of a low capacitance power transmission cable having an input end and an output end comprising a first and second conductor with insulation means and an outer sheathing conductor surrounding said first and second conductor and insulated from both said conductors, the other side of said first capacitor is connected to a node consisting of a side of a second compacitor, the center tap of the transformer, and the outer sheathing conductor of said transmission cable, the other side of said second capacitor is connected to a node consisting of the input end of the second conductor of said transmission cable and one side of a second inductor the other side of the second inductor is connected to the transformer second secondary, the output end of said power transmission cable is connected with the first conductor connected to one end of a gaseous discharge lamp and the second conductor connected to the other end of said gaseous discharge lamp.

6. A remote ballasting apparatus for starting and operating a pair of gaseous discharge lamps which allows operation of the lamps at frequencies in excess of 10 kilohertz and at a predetermined distance from the power supply comprising a high frequency power supply connected to the primary winding of an isolation transformer comprising at least a primary winding and first and second secondary windings arranged in a center tapped secondary configuration and wound to minimize interwinding capacitance, a resonant circuit to limit lamp current made up of one side of a first inductor connected to the transformer first secondary the other side of the first inductor connected to a node consisting of a first capacitor and the input end of the first conductor of a low capacitance power transmission cable having an input end and an output end comprising at least first, second and third conductors with insulation means and an outer sheathing conductor surrounding said first second and third conductors and insulated from said conductors, the other side of said first capacitor is connected to a node consisting of a side of a second capacitor, the center tap of the transformer, the third conductor and the outer sheathing conductor of said transmission cable, the other side of said second capacitor is connected to a node consisting of the input end of the second conductor of said transmission cable and one side of a second inductor, the other side of the second inductor is connected to the transformer second secondary, the output end of said power transmission cable is connected with the first conductor connected to one end of a first gaseous discharge lamp, the second conductor connected to one end of a second gaseous discharge lamp the other ends of said gaseous discharge lamps are connected to the output end of said third conductor.

7. A device is provided for connection between a source of high frequency electric power and a pair of gaseous discharge lamps comprising:

(I) a high frequency isolation transformer consisting of a primary winding and first and second secondary windings arranged in a center tapped secondary configuration and wound to minimize interwinding capacitance connected to;

(II) a resonant circuit to limit lamp current made up of a pair of inductors and capacitors having: the first secondary of said transformer connected to one side of a first inductor, the other side of said first inductor connected to a node consisting of a first capacitor and the input end of the first conductor of a low capacitance power transmission cable, the other side of said first capacitor is connected to a node consisting of one side of the second capacitor, the center tap of the transformer, a third conductor and a sheath conductor of a transmission cable and the other side of said second capacitor connected to a node consisting of the input end of the second conductor of said transmission cable and one side of a second inductor with the other side of said second inductor that is connected to the transformer second secondary;

(III) a low capacitance power transmission cable having an input end and an output end comprising at least first second and third conductors with insulation means and an outer sheathing conductor surrounding said first second and third conductors and insulated from said conductors;

(IV) the output end of said power transmission cable being connected with the first conductor connected to one end of a first gaseous discharge lamp, the second conductor connected to one end of a second gaseous discharge lamp the other ends of said gaseous discharge lamps are connected to the output end of said third conductor.

8. A remote ballasting apparatus according to claim 1 wherein a number of transformer secondaries with center taps connected to a common node are connected to a number of lamps via a single transmission cable comprising a number of conductor pairs surrounded by a single outer sheathing conductor which is connected to said center tap common node.

9. A remote ballasting apparatus according to claim 1 wherein a number of transformer secondaries with center taps are connected to a number of lamps via a single transmission cable comprising a number of conductor pairs each pair surrounded by a sheathing conductor which is connected to the respective transformer center tap.

10. A remote ballasting apparatus according to claim 2 wherein a number of transformer secondaries with center taps connected to a common node are connected to a number of lamps via a single transmission cable consisting of a number of three conductor groups surrounded by a single outer sheathing conductor which is connected to said center tap common node.

11. A remote ballasting apparatus according to claim 2 wherein a number of transformer secondaries with center taps are connected to a number of lamps via a single transmission cable consisting of a number of conductor groups wherein each group is surrounded by a sheathing conductor which is connected to the respective transformer center tap.

12. A remote ballasting apparatus according to claim 5 wherein a single transformer secondary with center tap is connected to a plurality of lamps via a single transmission cable consisting of a number of conductors surrounded by a sheathing conductor which is connected to the transformer center tap.

13. A remote ballasting apparatus according to claim 5 wherein a single transformer secondary with center tap is connected to a plurality of lamps via a single transmission cable consisting of a number of conductor groups wherein each group is surrounded by a sheathing conductor which is connected to the transformer center tap.

14. A remote ballasting apparatus comprising:

an isolation transformer having:

(a) a primary winding adapted for connection to a high frequency power supply, and (b) first and second secondary windings arranged in a center tapped secondary configuration;

current limiting means connected to said first and second secondary windings of said isolation transformer;

and a low capacitance power transmission cable having:

(a) a first conductor having:

(1) an input end connected to said current limiting means, and (2) an output end adapted for connection to a first end of a gaseous discharge lamp, (b) a second conductor having:

(1) an input end connected to the center tap of said first and second secondary windings of said isolation transformer, and (2) an output end adapted for connection to a second end of the gaseous discharge lamp, (c) an outer sheathing conductor surrounding said first conductor and said and second conductor and having:

(1) an input end connected to said center tap of said first and second secondary windings of said isolation transformer, and (2) an output end adapted for connection to the gaseous discharge lamp, and (d) means for insulating said outer sheathing conductor from said first conductor and said second conductor.

15. A remote ballasting apparatus according to claim 14 wherein said isolation transformer is wound to minimize interwinding capacitance.

16. A remote ballasting apparatus according to claim 14 wherein said current limiting means includes a series resonant circuit.

17. A remote ballasting apparatus according to claim 14 wherein said current limiting means includes a current limiting inductor through which said first conductor of said low capacitance power transmission line is connected to said first secondary winding of said isolation transformer.

18. A remote ballasting apparatus comprising:

an isolation transformer having:

(a) a primary winding adapted for connection to a high frequency power supply, and (b) first and second secondary windings arranged in a center tapped secondary configuration;

current limiting means connected to said first and second secondary windings of said isolation transformer;

and a low capacitance power transmission cable having:

(a) a first conductor having:

(1) an input end connected to said current limiting means, and (2) an output end adapted for connection to a first end of a first gaseous discharge lamp, (b) a second conductor having:

(1) an input end connected to said current limiting means, and (2) an output end adapted for connection to a first end of a second gaseous discharge lamp, (c) a third conductor having:

(1) an input end connected to the center tap of said first and second secondary windings of said isolation transformer, and (2) an output end adapted for connection to a second end of the first gaseous discharge lamp and a second end of the second gaseous discharge lamp, (d) an outer sheathing conductor surrounding said first conductor, said second conductor and said third conductor and having:

(1) an input end connected to the center tap of said first and second secondary windings of said isolation transformer, and (2) an output end adapted for connection to the second end of the first gaseous discharge lamp and the second end of the second gaseous discharge lamp, and (e) means for insulating said outer sheathing conductor from said first conductor, said second conductor and said third conductor.

19. A remote ballasting apparatus according to claim 18 wherein said current limiting means includes a series resonant circuit.

20. A remote ballasting apparatus according to claim 18 wherein said current limiting means includes a first current limiting inductor through which said first conductor of said low capacitance power transmission line is connected to said first secondary winding of said isolation transformer and a second current limiting inductor through which said second conductor of said low capacitance power transmission line is connected to said second secondary winding of said isolation transformer.

21. A remote ballasting apparatus comprising:

an isolation transformer having:

(a) a primary winding adapted for connection to a high frequency power source, (b) a first secondary winding having a marked end and an unmarked end, and (c) a second secondary winding having a marked end and an unmarked end;

current limiting means having:

(a) a first inductor having:

(1) a first end connected to said marked end of said first secondary winding of said isolation transformer, and (2) a second end, and (b) a second inductor having:

(1) a first end connected to said unmarked end of said second secondary winding of said isolation transformer, and (2) a second end, (c) a first capacitor having:

(1) a first end connected to said second end of said first inductor, and (2) a second end connected to said marked end of said second secondary winding of said isolation transformer, (d) a second capacitor having:

(1) a first end connected to said second end of said second inductor, and (2) a second end connected to:

(i) said unmarked end of said first secondary winding of said isolation transformer, and (ii) said second end of said first capacitor;

and a low capacitance power transmission line having:

(a) a first conductor having:

(1) a first end connected to:

(i) said second end of said first inductor of said current limiting means, and (ii) said first end of said first capacitor of said current limiting means, and (2) a second end adapted for connection to a first end of a first gaseous discharge lamp, (b) a second conductor having:

(1) a first end connected to:

(i) said second end of said second inductor of said current limiting means, and (ii) said first end of said second capacitor of said current limiting means, and (2) a second end adapted for connection to a first end of a second gaseous discharge lamp, (c) a third conductor having:

(1) a first end connected to:

(i) said second end of said first capacitor, (ii) said second end of said second capacitor, (iii) said unmarked end of said first secondary winding of said isolation transformer, and (iv) said marked end of said second secondary winding of said isolation transformer, and (2) a second end adapted for connection to:

(i) a second end of the first gaseous discharge lamp, and (ii) a second end of the second gaseous discharge lamp, (d) a sheath conductor through which said first conductor, said second conductor and said third conductor extend and having:

(1) a first end connected to:

(i) said second end of said first capacitor, (ii) said second end of said second capacitor, (iii) said unmarked end of said first secondary winding, and (iv) said marked end of said second secondary winding, and (2) a second end adapted for connection to the second end of the first gaseous discharge lamp and the second end of the second gaseous discharge lamp, and (e) means for insulating said sheath conductor from said first conductor, said second conductor and said third conductor.

22. A remote ballasting apparatus according to claim 4 wherein said first and second current limiting means include first and second current limiting inductors respectively.

23. A remote ballasting apparatus for starting and operating a pair of gaseous discharge lamps which allows operation of the lamps at frequencies in excess of 10 kilohertz and at a predetermined distance from the power supply comprising: a high frequency power supply connected to the primary winding of an isolation transformer comprising at least a primary winding and first and second secondary windings arranged in a center tapped secondary configuration and wound to minimize interwinding capacitance, a low capacitance power transmission cable having an input end and an output end comprising at least first, second and third conductors with insulation means and an outer sheathing conductor surrounding said first, second and third conductors and insulated from said conductors connected with the input end of said first and second conductors connected in series through first and second current limiting means respectively, each including a current limiting inductor, to the first and second secondary windings respectively of said isolation transformer and the outer sheathing conductor and one end of the third conductor connected to the center tap of said isolation transformer, the output end of said power transmission cable is connected with the first conductor connected to one end of a first gaseous discharge lamp, the second conductor connected to one end of a second gaseous discharge lamp, the other ends of said gaseous discharge lamps are connected to the output end of said third conductor.

24. A remote ballasting apparatus comprising:

an isolation transformer having:

(a) a primary winding, and (b) first and second secondary windings arranged in a center tapped secondary configuration;

current limiting means connected to said primary winding of said isolation transformer and adapted for connection to a high frequency power supply;

and a low capacitance power transmission cable having:

(a) a first conductor having:

(1) an input end connected to said first secondary winding of said isolation transformer, and (2) an output end adapted for connection to a first end of a gaseous discharge lamp, (b) a second conductor having:

(1) an input end connected to said second secondary winding of said isolation transformer, and (2) an output end adapted for connection to a second end of the gaseous discharge lamp, (c) an outer sheathing conductor surrounding said first conductor and said second conductor and having:

(1) an input end connected to the center tap of said first secondary winding and said second secondary winding of said isolation transformer, and (2) an output end adapted for connection to the gaseous discharge lamp, and (d) means for insulating said outer sheathing conductor from said first conductor and said second conductor.

25. A remote ballasting apparatus comprising:

an isolation transformer having:

(a) a primary winding adapted for connection to a high frequency power supply, and (b) first and second secondary windings arranged in a center tapped secondary configuration;

current limiting means connected to said first and second secondary windings of said isolation transformer;

and a low capacitance power transmission cable having:

(a) a first conductor having:

(1) an input end connected to said first secondary winding of said isolation transformer through said current limiting means, and (2) an output end adapted for connection to a first end of a gaseous discharge lamp, (b) a second conductor having:

(1) an input end connected to said second secondary winding of said isolation transformer through said current limiting means, and (2) an output end adapted for connection to a second end of the gaseous discharge lamp, (c) an outer sheathing conductor surrounding said first conductor and said second conductor and having:

(1) an input end connected to the center tap of said first secondary winding and said second secondary winding of said isolation transformer, and (2) an output end adapted for connection to the gaseous discharge lamp, and (d) means for insulating said outer sheathing conductor from said first conductor and said second conductor.

* * * * *

UNITED STATES PATENT AND TRADEMARK OFFICE

CERTIFICATE OF CORRECTION

PATENT NO. : 5,936,359
DATED : August 10, 1999
INVENTOR(S) : J. Alan Gibson

It is certified that error appears in the above-identified patent and that said Letters Patent is hereby corrected as shown below:

In claim 1, column 8, line 38, after "an" insert the words --electrically conductive--.

In claim 2, column 8, line 60, after "an" insert the words --electrically conductive--.

In claim 3, column 9, line 26, after "an" insert the words --electrically conductive--.

In claim 6, column 10, line 42, after "first" insert --,--.

Signed and Sealed this

Sixteenth Day of May, 2000

*Attest:*

Q. TODD DICKINSON

*Attesting Officer*

*Director of Patents and Trademarks*